US011779802B2

(12) United States Patent
Tseng

(10) Patent No.: US 11,779,802 B2
(45) Date of Patent: Oct. 10, 2023

(54) FITNESS MACHINE AND RESISTANCE DEVICE THEREOF

(71) Applicants: Xiamen DMaster Health Tech Co., Ltd., Fujian (CN); Ching Tseng, Taiwan (CN)

(72) Inventor: Ching Tseng, Taiwan (CN)

(73) Assignees: Ching Tseng, Taiwan (CN); Xiamen DMaster Health Tech Co., Ltd., Fujian (CN)

( * ) Notice: Subject to any disclaimer, the term of this patent is extended or adjusted under 35 U.S.C. 154(b) by 244 days.

(21) Appl. No.: 17/299,401

(22) PCT Filed: Jul. 22, 2020

(86) PCT No.: PCT/CN2020/103519
§ 371 (c)(1),
(2) Date: Jun. 3, 2021

(87) PCT Pub. No.: WO2021/159665
PCT Pub. Date: Aug. 19, 2021

(65) Prior Publication Data

US 2023/0135018 A1 May 4, 2023

(30) Foreign Application Priority Data

Feb. 11, 2020 (CN) ..... 202020159974.5

(51) Int. Cl.
*A63B 22/06* (2006.01)
*A63B 21/005* (2006.01)
*A63B 21/008* (2006.01)

(52) U.S. Cl.
CPC ..... *A63B 22/06* (2013.01); *A63B 21/0051* (2013.01); *A63B 21/0088* (2013.01)

(58) Field of Classification Search
CPC ..... A63B 21/00192; A63B 21/005; A63B 21/0051; A63B 21/0052; A63B 21/0056;
(Continued)

(56) References Cited

U.S. PATENT DOCUMENTS 9,662,534 B1 * 5/2017 Liu ..... A63B 21/0051
10,561,878 B2 * 2/2020 Wu ..... A63B 21/22
(Continued)

FOREIGN PATENT DOCUMENTS

CN 2688323 Y 3/2005
CN 208287386 U 12/2018
(Continued)

OTHER PUBLICATIONS

International Search Report cited in PCT/CN2020/103519 dated Nov. 11, 2020, 4 pages.

*Primary Examiner* — Sundhara M Ganesan
*Assistant Examiner* — Zachary T Moore
(74) *Attorney, Agent, or Firm* — Cooper Legal Group, LLC

(57) ABSTRACT

Provided is a resistance device of a fitness machine comprising a wind drag unit and a magnetic resistance unit. The wind drag unit includes an air volume adjusting disc. The magnetic resistance unit includes a guide rail disc, a metal ring sheet, at least one magnetic seat, and at least one guide post. The guide rail disc has a guide disc rail through which the guide post penetrates. The magnetic seat is used to generate magnetic resistance with the metal ring sheet, and the magnetic seat has a magnetic seat rail. The guide post is connected to the air volume adjusting disc, penetrates through the guide disc rail, and extends into the magnetic seat rail. The guide post moves in the magnetic seat rail with rotation of the air volume adjusting disc to drive the magnetic seat to pivotally rotate relative to the guide rail disc.

18 Claims, 8 Drawing Sheets

(58) Field of Classification Search
CPC ..... A63B 21/0057; A63B 21/0084; A63B 21/00845; A63B 21/0085; A63B 21/0088
See application file for complete search history.

(56) References Cited

U.S. PATENT DOCUMENTS

| | | | | |
|---|---|---|---|---|
| 10,668,313 | B2 | 6/2020 | Hsu | |
| 2016/0208638 | A1* | 7/2016 | Chen | A63B 22/0605 |
| 2016/0298654 | A1* | 10/2016 | Wang | A63B 21/0051 |
| 2017/0319889 | A1* | 11/2017 | Cei | A63B 21/225 |
| 2018/0135655 | A1* | 5/2018 | Chen | F04D 29/4213 |
| 2018/0290015 | A1* | 10/2018 | Xing | A63B 21/0088 |
| 2020/0306580 | A1* | 10/2020 | Wang | A63B 21/0088 |
| 2021/0205650 | A1* | 7/2021 | Wang | A63B 21/0052 |
| 2021/0220690 | A1* | 7/2021 | Wang | A63B 23/1209 |

FOREIGN PATENT DOCUMENTS

| | | |
|---|---|---|
| CN | 109939413 | 6/2019 |
| CN | 111167066 A | 5/2020 |
| TW | M579988 U | 7/2019 |

* cited by examiner

FITNESS MACHINE AND RESISTANCE DEVICE THEREOF

TECHNICAL FIELD

The present application relates to fitness equipment, and in particular, to a fitness machine and a resistance device thereof.

BACKGROUND

A flywheel fitness bike imitates the feeling of real riding of a road bike, can simulate different riding slopes or resistances through a multi-level resistance device, and can train a heart, lungs, legs and whole body muscles at the same time. In addition, the flywheel fitness bike has good durability and is very suitable for trainers who want to perform High-intensity Interval Training (HIIT).

Current resistance devices include two types: a wind drag type and a magnetic resistance type. The single wind drag type resistance device or the single magnetic resistance type resistance device has a relatively small resistance adjusting range and cannot satisfy requirements of some users. Therefore, there are also flywheel fitness bikes on the market that have both wind drag and magnetic resistance, but the means of adjusting the wind drag and the magnetic resistance thereof are operated separately, which are troublesome and inconvenient to use.

SUMMARY

Therefore, an object of the present application is to provide a resistance device of a fitness machine, which is convenient for adjusting the resistance and has a relatively large resistance adjusting range.

In order to achieve the above object, a technical solution of the present application is: a resistance device of a fitness machine including a wind drag unit and a magnetic resistance unit.

The wind drag unit includes a housing, a wind wheel, a rotation shaft, and an air volume adjusting disc, the wind wheel and the air volume adjusting disc are mounted in the housing, the wind wheel is fixedly connected to the rotation shaft and is rotatable around an axis of the rotation shaft relative to the housing, the air volume adjusting disc is rotatable relative to the housing and coordinates with the housing to define a flow channel for air flow, and a flow rate of the flow channel is adjusted by rotating the air volume adjusting disc;

the magnetic resistance unit is adjustably provided in the wind drag unit, and the magnetic resistance unit includes:

a guide rail disc that surrounds the axis of the rotation shaft and is fixedly connected to the housing, the guide rail disc has at least one guide disc rail;

a metal ring sheet that surrounds the axis of the rotation shaft and rotates with the wind wheel;

at least one magnetic seat that has magnetism and is used to generate a magnetic resistance with the metal ring sheet, the magnetic seat is pivotally provided on the guide rail disc and has a magnetic seat rail; and at least one guide post, a number of the guide post being the same as a number of the magnetic disc, the guide post is connected to the air volume adjusting disc and penetrates through the guide disc rail and extends into the magnetic seat rail, the guide post moves in the magnetic seat rail with the rotation of the air volume adjusting disc to drive the magnetic seat to pivotally rotate relative to the guide rail disc so as to adjust the magnetic resistance between the magnetic seat and the metal ring sheet.

In a further improvement, the magnetic seat rail has a first end, a second end opposite to the first end, and a turning portion between the first end and the second end; when the guide post is located at the second end, the resistance device of the fitness machine only generates a wind drag, and when the guide post slides from the second end and passes through the turning portion, the resistance device of the fitness machine generates the wind drag and the magnetic resistance at the same time.

Furthermore, the magnetic seat further has a pivot point pivotally connected to the guide rail disc and a magnetic region far away from the pivot point and for generating the magnetic resistance with the metal ring sheet, the magnetic seat rail extends in a direction from the pivot point toward the magnetic region, the magnetic seat rail bends at a position near to the magnetic region, the magnetic resistance generated when the guide post slides to the first end is greater than the magnetic resistance generated when the guide post slides to the second end.

Furthermore, the at least one magnetic seat has a seat body pivotally connected to the guide rail disc and at least one magnetic member provided on the seat body, the seat body has a magnetic seat rail, the magnetic member forms the magnetic region, and a projection of the magnetic member overlaps the metal ring sheet when the guide post is located at the first end; the projection of the magnetic member does not fall within a range of the metal ring sheet when the guide post is located at the second end of the magnetic seat rail.

Preferably, the magnetic resistance unit includes two magnetic seats and two guide posts, and the magnetic seats are symmetrically arranged about the axis of the rotation shaft as a center.

Preferably, each magnetic seat has a seat body pivotally connected to the guide rail disc, and at least one magnetic member provided on the seat body.

Preferably, a position of the magnetic seat on the axis of the rotation shaft is between the guide rail disc and the metal ring sheet.

In a further improvement, the wind drag unit further includes an indicator fixed to the air volume adjusting disc, the indicator is exposed from the housing and used to indicate a resistance level, so as to indicate a magnitude of the generated resistance and facilitate a trainer to use.

Preferably, the metal ring sheet is in an annular shape, the guide rail disc is in a disc shape, a central axis of the metal ring sheet and a central axis of the guide rail disc overlap each other.

Another object of the present application is to provide a fitness machine which is convenient to adjust a wind drag and a magnetic resistance at the same time.

Thus, the fitness machine of the present application includes a frame unit, a force application assembly operationally provided on the frame unit and the resistance device of the fitness machine described-above, the resistance device of the fitness machine is used to generate a resistance and mounted on the frame unit and connected to the force application assembly.

Effects of the present invention lie in: generating a wind drag through a wind drag unit, generating a magnetic resistance through a magnetic resistance unit, adjusting a magnitude of the wind drag by rotating the air volume adjusting disc, and in a process of adjusting the wind drag, the air volume adjusting disc can drive the at least one guide post to slide relative to the guide rail disc to make the at least one magnetic seat pivotally rotate, thereby changing a degree of the overlap of the magnetic region of the magnetic seat on the metal ring sheet to adjust the magnitude of the magnetic resistance. Thus, the magnitudes of the wind drag and the magnetic resistance can be adjusted at the same time as long as the air volume adjusting disc is rotated, and the adjustment of the resistance is very convenient. On another aspect, since the wind drag and the magnetic resistance are superposed to generate the resistance, an adjusting range of the resistance is relatively large. It can generate greater movement resistance, improve training effects, and meet the needs of different trainers.

SYMBOL EXPLANATION

Figure 1:
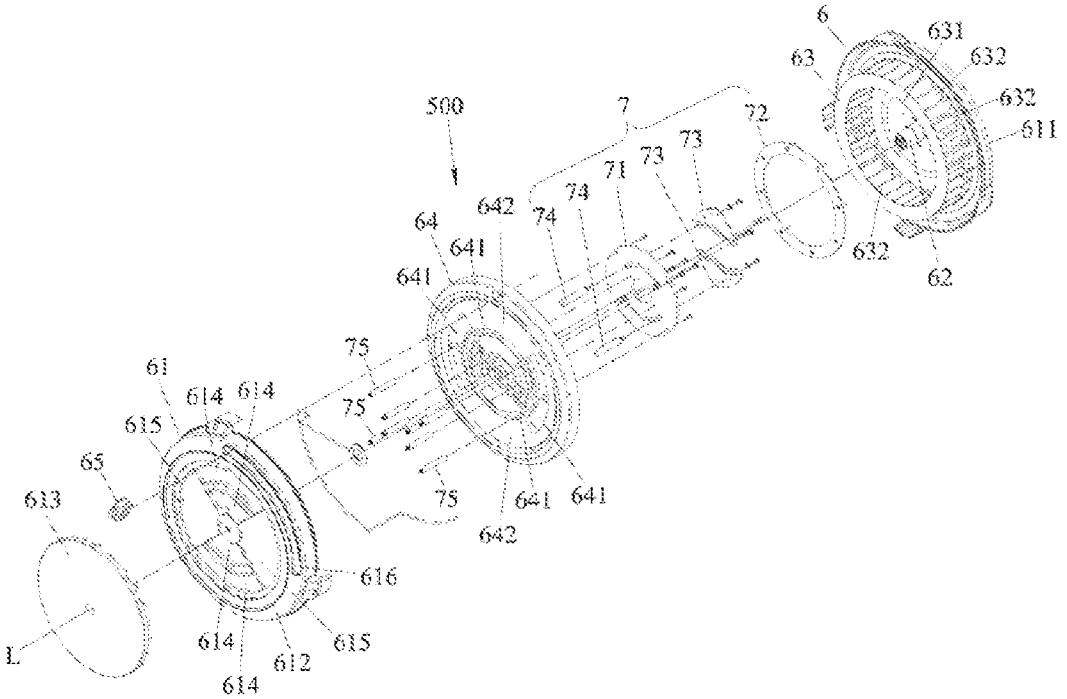
FIG. 1 is a perspective exploded view of a resistance device of the present application.

1. Fitness Machine, 1'. Fitness Machine, 1". Fitness Machine, 10. Frame Unit, 10'. Frame Unit, 10". Frame Unit, 20. Force Application Assembly, 20'. Force Application Assembly, 20". Force Application Assembly, 30. Armrest, 40. Saddle, 40'. Saddle, 500. Resistance Device, 6. Wind Drag Unit, 61. Housing, 611. Bottom Cover, 612. Outer Cover, 613. Protection Cover, 614. Air Inlet Region, 615. Shielding Region, 616. Opening Slot, 62. Rotation Shaft, 63. Wind Wheel, 631. Fixing Sheet, 632. Blade, 64. Air Volume Adjusting Disc, 641. Opening Region, 642. Blocking Region, 65. Indicator, 7. Magnetic Resistance Unit, 71. Guide Rail Disc, 711. Guide Disc Rail, 72. Metal Ring Sheet, 73. Magnetic Seat, 730. Magnetic Region, 731. Seat Body, 732. Magnetic Member, 733. Pivot Point, 734. Magnetic Seat Rail, 735. First End, 736. Second End, 737. Turning Portion, 74. Guide Post, 75. Connection Rod, I. Flow Channel, L. Axis, X. Front-rear Direction.

DETAILED DESCRIPTION OF THE EXEMPLARY EMBODIMENTS

The present application provides accompanying drawings in order to further illustrate respective embodiments. These drawings are a part of the contents disclosed by the present application, which are mainly used to illustrate the embodiments and can explain an operation principle of the embodiments in cooperation with the relevant depiction in the description. With reference to these contents, those ordinarily skilled in the art should understand other possible embodiments and the advantages of the present invention. The components in the drawings are not drawn to scale, and similar component symbols are generally used to represent similar components.

Now the present application is further described in conjunction with the drawings and the exemplary embodiments.

Before the present application is described in details, it should be noted that in the following description contents, the so-called front-rear direction X is based on an orientation viewed by a trainer.

With reference to FIG. 1 to FIG. 5, a resistance device 500 of a fitness machine is described. The resistance device 500 is used to generate a multi-level movement resistance to expand a resistance adjusting range and facilitate improvement on exercise intensity. The resistance device 500 includes a wind drag unit 6 for generating a wind drag and a magnetic resistance unit 7 for generating a magnetic resistance.

Figure 2:
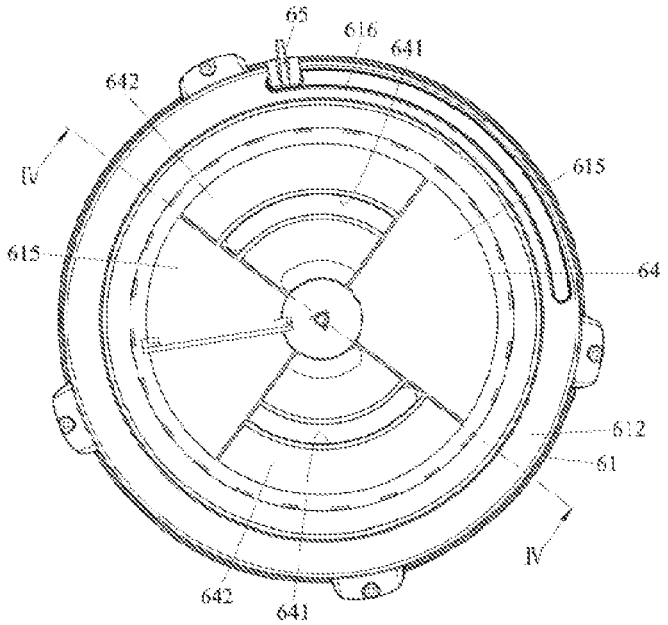
FIG. 2 is a side view of the resistance device of the present application, in which a protection cover is omitted.
Figure 3:
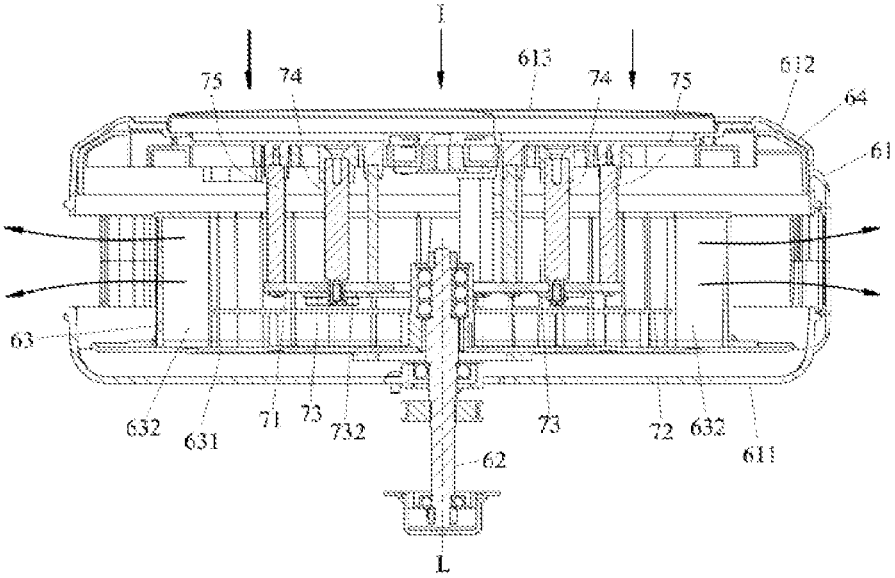
FIG. 3 is a cross-section view sectioned along a line IV-IV in FIG. 2.
Figure 4:
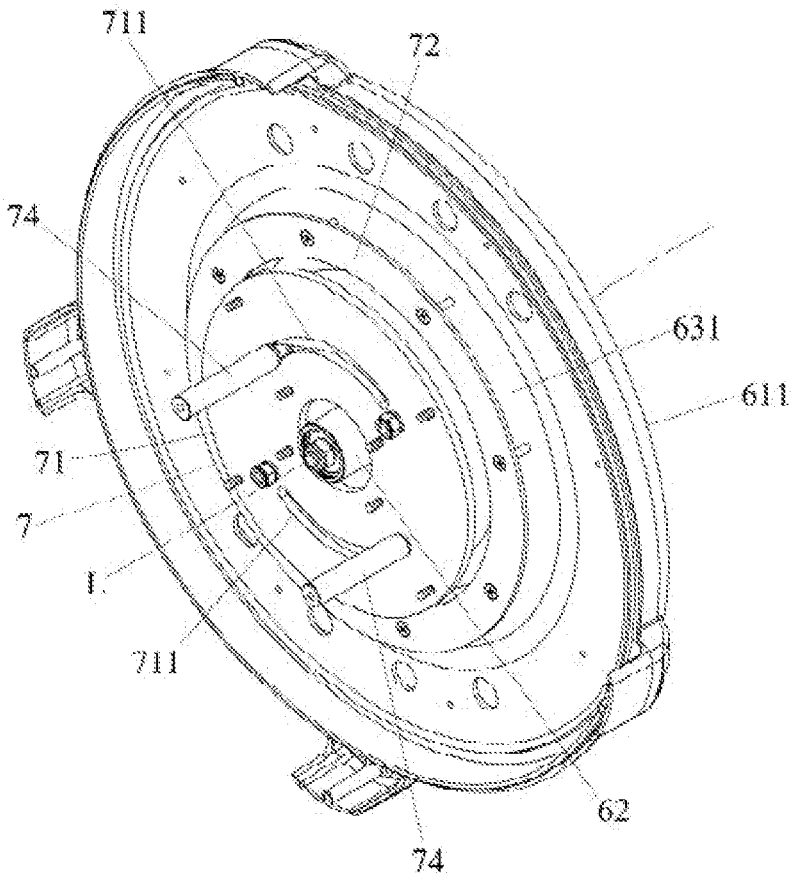
FIG. 4 is a perspective view of a magnetic resistance unit of the resistance device of the present application.

With reference to FIG. 2 to FIG. 4, the wind drag unit 6 is actually in a shape of a drum and includes a housing 61, a rotation shaft 62, a wind wheel 63, an air volume adjusting disc 64, and an indicator 65. The housing 61 has a bottom cover 611, an outer cover 612 attachably mounted on the bottom cover 611, and a protection cover 613. More preferably, the outer cover 612 has a plurality of air inlet regions 614 and a plurality of shielding regions 615. Each of the air inlet regions 614 is a hollowed-out structure for air inflow, and each of the shielding regions 615 is a solid structure for blocking air inflow. The protection cover 613 is provided to cover the outer cover 612 and prevent dust, and has an effect of appearance decoration.

The rotation shaft 62 extends along an axis L and is rotatably mounted to the bottom cover 611. The wind wheel 63 is sleeved on the rotation shaft 62, fixedly connected to the rotation shaft 62, and driven by the rotation shaft 62 to rotate relative to the housing 61 and generate the wind drag. The wind wheel 63 has a fixing sheet 631 through which the rotation shaft 62 penetrates and to which the rotation shaft 62 is fixedly connected and a plurality of blades 632 that are arranged at intervals along a circumferential direction and provided on the fixing sheet 631.

The air volume adjusting disc 64 is rotatably connected to the outer cover 612 to rotate relative to the housing 61, and the air volume adjusting disc 64 coordinates with the outer cover 612 to define a flow channel I for air inflow. More preferably, the air volume adjusting disc 64 has a plurality of opening regions 641 for air inflow and a plurality of blocking regions 642 for blocking the air inflow. Each opening region 641 is a hollowed-out structure, and each blocking region 642 is a solid structure. The opening regions 641, the blocking regions 642, the air inlet regions 614, and the shielding regions 615 coordinate with each other to define the flow channel I, and a flow rate of the flow channel I is adjusted by rotating the air volume adjusting disc 64 to generate the wind drag from low to high.

The indicator 65 is fixed on the air volume adjusting disc 64 and exposed from an opening slot 616 of the outer cover 612 of the housing 61. Numerals of resistance levels (not shown in the figures) are etched on the housing 61. The indicator 65 can slide within the opening slot 616 with the rotation of the air volume adjusting disc 64 and rotate relative to the outer cover 612, thereby indicating the resistance level to facilitate the trainer distinguishing visually.

The magnetic resistance unit 7 is adjustably provided in the housing 61 of the wind drag unit 6, and the magnetic resistance unit 7 includes a guide rail disc 71, a metal ring sheet 72, two magnetic seats 73, and two guide posts 74.

The guide rail disc 71 and the outer cover 612 are located at both sides of the air volume adjusting disc 64, and the guide rail disc 71 is substantively in a disc shape and surrounds the axis L. The guide rail disc 71 is fixedly connected to the outer cover 612 through a plurality of connection rods 75 penetrating through the opening regions 641 of the air volume adjusting disc 64, and the guide rail disc 71 is manufactured by a material that will not be adsorbed by a magnetic stone (such as a plastic or aluminum material). The guide rail disc 71 has two guide disc rails 711, and more preferably, the guide disc rails 711 are arc shaped opening slots and symmetrically arranged about the axis L as a center. The metal ring sheet 72 is raised and fixed to the fixing sheet 631 of the wind wheel 63, and metal ring sheet 72 of this embodiment is manufactured by aluminum but can also be manufactured by other metals that can generate eddy current, such as iron or copper. The metal ring sheet 72 is substantively in an annular shape, surrounds the axis L, and rotates with the wind wheel 63. More preferably, a projection of the metal ring sheet 72 on the axis L is located outside the guide rail disc 71. Most preferably, the metal ring sheet 72 is coaxial with the guide rail disc 71 and the air volume adjusting disc 64. The metal ring sheet 72 is located between the fixing sheet 631 and the guide rail disc 71. In other variations, the metal ring sheet 72 can also be eccentrically provided or located between the air volume adjusting disc 64 and the guide rail disc 71.

Figure 5:
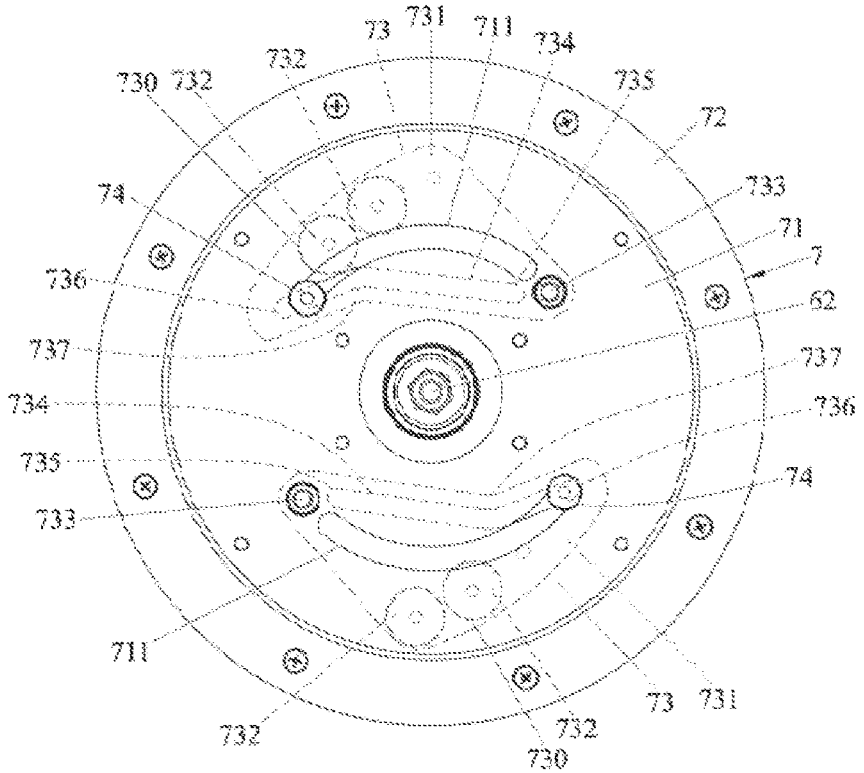
FIG. 5 is an incomplete side view illustrating that each guide post of the magnetic resistance unit is located at a second end of each magnetic seat rail.

With further reference to FIG. 3 to FIG. 5, the magnetic seats 73 have magnetism and are used to generate the magnetic resistance with the metal ring sheet 72. This embodiment has two magnetic seats 73. However, in other variations, the number of the magnetic seats 73 may be one or more than three and can be varied according to the magnetic requirement. The magnetic seats 73 are symmetrically arranged about the axis L as a center and can be pivotally provided on the guide rail disc 71. Positions of the magnetic seats 73 on the axis L are located between the guide rail disc 71 and the metal ring sheet 72. Each magnetic sheet 73 has a seat body 731 pivotally connected to the guide rail disc 71 and two magnetic members 732 provided on the seat body 731. The seat body 731 has a pivot point 733 pivotally connected to the guide rail disc 71 and a magnetic seat rail 734 that is an opening slot. The magnetic seat rail 734 has a first end 735 adjacent to the pivot point 733, a second end 736 opposite to the first end 735, and a turning portion 737 between the first end 735 and the second end 736. The magnetic members 732 are far away from the pivot point 733 and form a magnetic region 730 for generating the magnetic resistance with the metal ring sheet 72, and the magnetic seat rail 734 extends in a direction from the pivot point 733 toward the magnetic region 730 and bends at a position near to the magnetic region 730. In this embodiment, each magnetic member 732 is a circular magnet and provided on a side surface of the seat body 731 adjacent to the bottom cover 611. In other variations, the magnetic members 732 can also be a block-shaped magnet and spliced and combined with the seat body 731 to form the magnetic region 730.

The number of the guide posts 74 adapts to the number of the guide disc rails 711 and the number of the magnetic seats 73. One end of each guide post 74 is connected to the air volume adjusting disc 64, and the other end of each guide post 74 penetrates through the respective guide disc rail 711 and extends into the corresponding magnetic seat rail 734. Thus, each guide post 74 can move in the respective magnetic seat rail 734 and the corresponding guide disc rail 711 at the same time with the rotation of the air volume adjusting disc 64, thereby driving the respective magnetic seat 73 to pivotally rotate about the pivot point 733 as a center relative to the guide rail disc 71, so that the projection of the respective magnetic seat 73 gradually overlaps the metal ring sheet 72. Moreover, since there is generated a relative movement between the metal ring sheet 72 and the magnetic seats 73 with continuously rotation of the wind wheel 63, a magnetic flux on a surface of the metal ring sheet 72 will be caused to change, so as to produce the eddy current and generate the magnetic resistance.

With respect to FIG. 2 to FIG. 5, when the indicator 65 points at the lowest position of the resistance levels, the flow rate of the flow channel I (see FIG. 3) is at a minimum. The wind wheel 63 drives the metal ring sheet 72 to rotate relative to the housing 61, the air volume adjusting disc 64, the guide rail disc 71, and the magnetic seats 73, and the generated wind drag is at a minimum. Moreover, when the guide posts 74 are located at the second ends 736 of the magnetic seat rails 734, the projections of the magnetic members 732 do not fall within a range of the metal ring sheet 72, and at this time, the magnetic resistance unit 7 does not generate the magnetic resistance.

Figure 6:
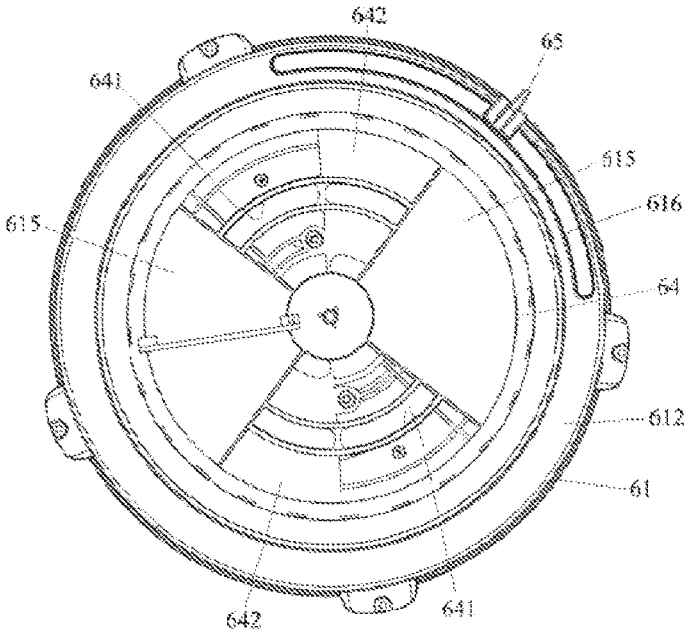
FIG. 6 is a view similar to FIG. 2 and illustrating that as the air volume adjusting disc is rotated, a wind drag becomes greater.
Figure 7:
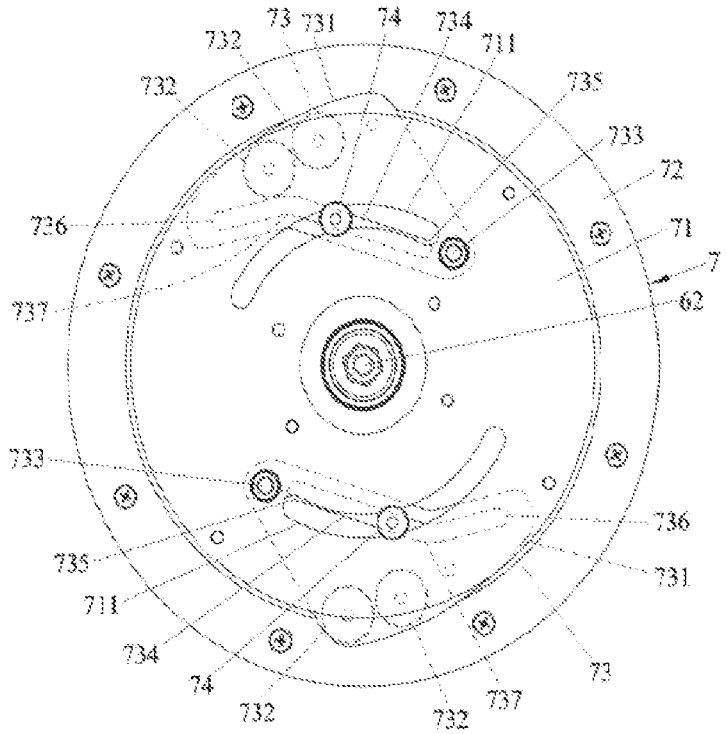
FIG. 7 is a view similar to FIG. 5 and illustrating that when each guide post of the magnetic resistance unit passes through a turning portion of each magnetic seat rail, the magnetic resistance unit starts to generate a magnetic resistance.

With reference to FIG. 6 and FIG. 7, the air volume adjusting disc 64 (see FIG. 2) is rotated, the indicator 65 moves along and points at a middle position of the resistance levels, and at this time, the flow rate of the flow channel I and the wind drag are increased. Meanwhile, the guide posts 74 are driven to pass through the turning portions 737 from the second ends 736, the magnetic seats 73 are pushed until a part of the projections of the magnetic members 732 overlaps the metal ring sheet 72, and, due to the rotation of the metal ring sheet 72, the magnetic resistance unit 7 starts to generate the magnetic resistance.

Figure 8:
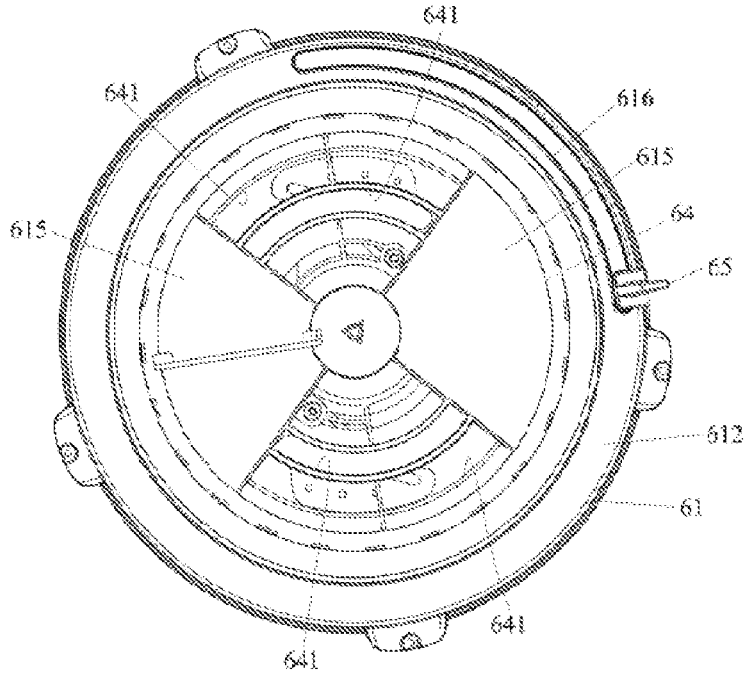
FIG. 8 is a view similar to FIG. 6 and illustrating that the air volume adjusting disc is continuously rotated to a maximum flow rate of the wind drag.
Figure 9:
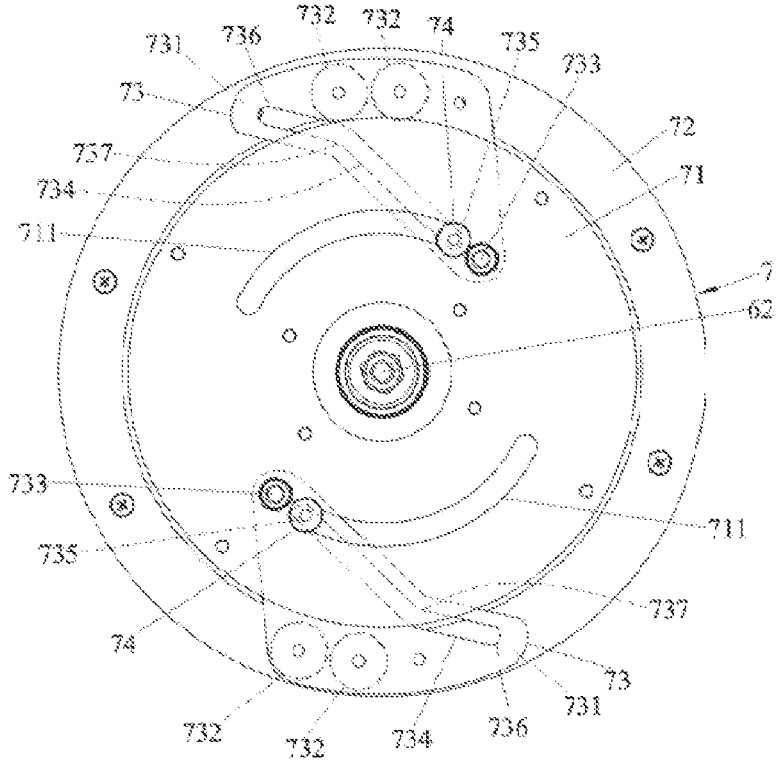
FIG. 9 is a view similar to FIG. 7 and illustrating that when each guide post of the magnetic resistance unit is located at a first end of each magnetic seat rail, the resistance of the magnetic resistance unit is at a maximum.

With reference to FIG. 8 and FIG. 9, the air volume adjusting disc 64 is continuously rotated until the indicator 65 points at the highest position of the resistance levels, and at this time, the flow rate of the flow channel I and the wind drag are at a maximum. Moreover, the guide posts 74 are driven to move to the first ends 735 from the turning portions 737, the magnetic seats 73 are pushed until the projections of the magnetic members 732 completely overlap the metal ring sheet 72 to make the magnetic resistance of the magnetic resistance unit 7 reach a maximum.

The present application adjusts the wind drag and the magnetic resistance at the same time by the guide posts 74 driving the magnetic seats 73 to pivotally rotate to make the magnetic resistance of the magnetic resistance unit 7 gradually increase in a direction from the second ends 736 toward the first ends 735. This not only facilitates the resistance adjustment, but also increases an adjusting range of the resistance.

Whereby, when a trainer selects the lowest resistance level, the guide posts 74 are located at the second ends 736, and at this time, the resistance device 500 only generates the minimum wind drag without generating the magnetic resistance. As the resistance level is adjusted to be high, after the guide posts 74 respectively slide from the second ends 736 and pass through the turning portions 737, the wind drag is increased and the resistance device 500 generates the magnetic resistance at the same time. When the guide posts 74 are moved to the first ends 735, the wind drag and the magnetic resistance reach a maximum at the same time, the resistance level is highest, and the exercise intensity is at a maximum. Thus, the trainer can adjust the wind drag and the magnetic resistance synchronously through rotation of the air volume adjusting disc 64 and can increase the movement resistance and improve the training effect without two operation adjustments. It is more convenient to use and can indeed achieve the purposes of the present invention.

It should be understood that the so-called guide posts 74 in the first embodiment are located at the second ends 736 of the magnetic seat rails 734, and this should be understood as adjacent to or near to the second ends 736 in the practical situation. It is not intended that the two guide posts 74 must fall on the second ends 736 simultaneously and completely. In addition, in other variations, as along as shapes, sizes, or orientations of the magnetic seat rails 734 are slightly changed, the resistance level for starting to generate the magnetic resistance can be changed, and it is not intend that the magnetic resistance unit 7 starts to generate the magnetic resistance from a center resistance level.

Figure 10:
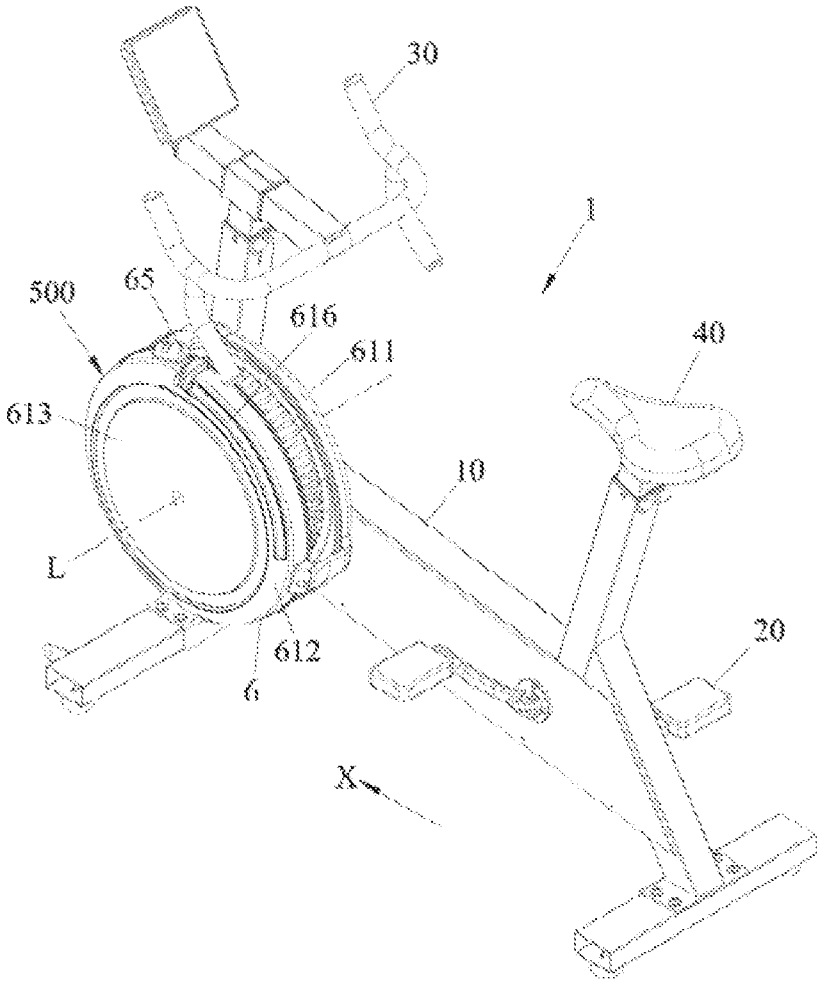
FIG. 10 is a perspective view of a first embodiment of a fitness machine of the present application.

With reference to FIG. 10, the first embodiment of a fitness machine 1 of the present application is a flywheel fitness bike, and the fitness machine 1 includes a frame unit 10, a force application assembly 20, an armrest 30, a saddle 40, and a resistance device 500.

The frame unit 10 extends along a front-rear direction X. The force application assembly 20 is two pedals and is operationally provided on a rear end of the frame unit 10 for pedaling by the trainers feet, respectively. The armrest 30 is provided on a front end of the frame unit 10 for being held by the trainer with both hands. The saddle 40 is provided on the frame unit 10 for the trainer to ride.

The resistance device 500 is mounted on the front end of the frame unit 10 and connected to the force application assembly 20 through a sprocket chain assembly (not shown in the figures). The resistance device 500 is used to generate resistance on the force application assembly 20.

Figure 11:
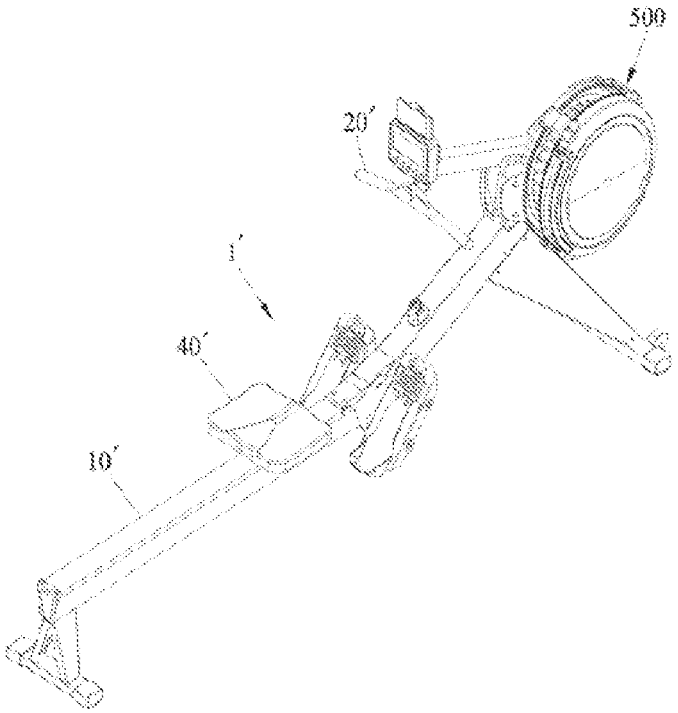
FIG. 11 is a perspective view of a second embodiment of the fitness machine of the present application.

With reference to FIG. 11, a second embodiment of the present application is similar to the first embodiment, and differences therebetween lie in: the fitness machine 1' is a rowing machine and includes a frame unit 10', a force application assembly 20' provided on the frame unit 10', a saddle 40' for riding, and the resistance device 500. The trainer rides on the saddle 40' and applies force to the force application assembly 20' with both hands. Various rowing situations can be simulated through the resistance device 500. In addition to training the abdomen, the lower body can also drive the core muscles and link the upper body muscles to improve the exercise effect.

Figure 12:
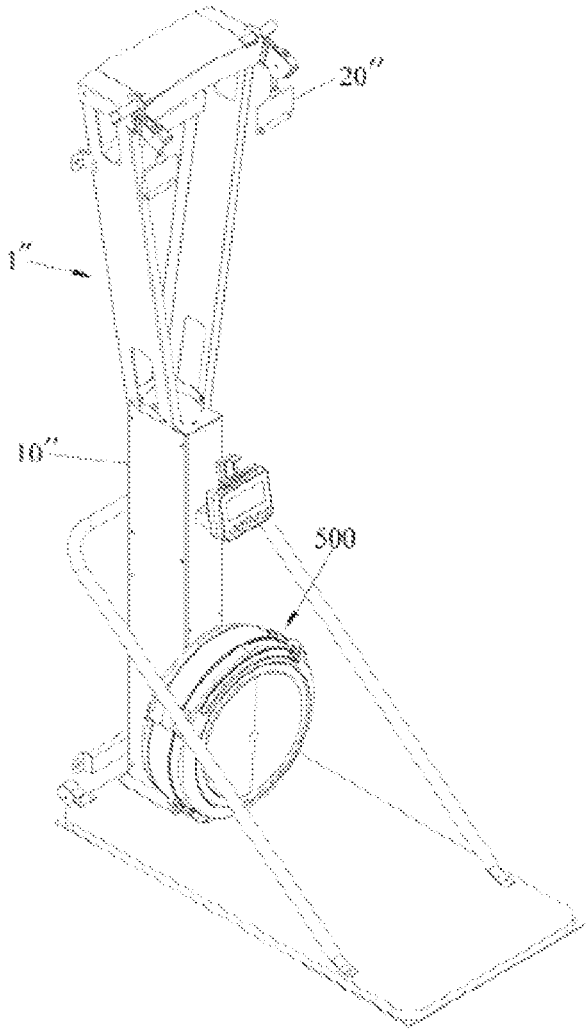
FIG. 12 is a perspective view of a third embodiment of the fitness machine of the present application.

With reference to FIG. 12, a third embodiment of the present application is similar to the first embodiment, and differences therebetween lie in: the fitness machine 1" is a skiing machine and includes a frame unit 10", a force application assembly 20" provided on the frame unit 10", and the resistance device 500. During a training process, lower limbs need to stand stably, forces are applied to the force application assembly 20" with both hands, various skiing slopes are simulated through the resistance device 500, and training of upper limbs including triceps, back, and core muscles can be strengthened.

Thus, the resistance device 500 of the present application can be applied to flywheel fitness bikes, rowing machines, skiing machines, upright fitness bikes, recumbent fitness bikes, sliding step machines, elliptical trainers, or resistance exercise equipment of other types, but the applications of the present application are not limited thereto.

Although the present application is specifically exhibited and introduced in conjunction with the preferable embodiments, those skilled in the art should understand that various changes can be made on forms and details of the present application without departing from the spirit and scope of the present application defined by the accompanying claims, and all fall within the protection scope of the present application.

What is claimed is:

1. A resistance device of a fitness machine, comprising:
a wind drag unit; and
a magnetic resistance unit, wherein:
the wind drag unit comprises a housing, a wind wheel, a rotation shaft, and an air volume adjusting disc,
the wind wheel and the air volume adjusting disc are mounted in the housing,
the wind wheel is fixedly connected to the rotation shaft and is rotatable around an axis of the rotation shaft relative to the housing,
the air volume adjusting disc is rotatable relative to the housing and coordinates with the housing to define a flow channel for air flow,
a flow rate of the flow channel is adjusted by rotating the air volume adjusting disc,
the magnetic resistance unit is adjustably provided in the wind drag unit, and
the magnetic resistance unit comprises:
a guide rail disc that surrounds the axis of the rotation shaft and is fixedly connected to the housing, wherein the guide rail disc has at least one guide disc rail;
a metal ring sheet that surrounds the axis of the rotation shaft and rotates with the wind wheel;
at least one magnetic seat that has magnetism and is configured to generate a magnetic resistance with the metal ring sheet, wherein the at least one magnetic seat is pivotally provided on the guide rail disc and has a magnetic seat rail; and
at least one guide post that is connected to the air volume adjusting disc and penetrates through the at least one guide disc rail and extends into the magnetic seat rail, the at least one guide post moves in the magnetic seat rail with rotation of the air volume adjusting disc to drive the at least one magnetic seat to pivotally rotate relative to the guide rail disc so as to adjust relative positions of the at least one magnetic seat and the metal ring sheet, so that a magnitude of the magnetic resistance is adjustable.

2. The resistance device of the fitness machine of claim 1, wherein:
the magnetic seat rail has a first end, a second end opposite to the first end, and a turning portion between the first end and the second end,
when the at least one guide post is located at the second end, the resistance device of the fitness machine only generates a wind drag, and when the at least one guide post slides from the second end and passes through the turning portion, the resistance device of the fitness machine generates the wind drag and the magnetic resistance at the same time.

3. The resistance device of the fitness machine of claim 2, wherein:

the at least one magnetic seat further has a pivot point pivotally connected to the guide rail disc and a magnetic region a distance away from the pivot point for generating the magnetic resistance with the metal ring sheet, the magnetic seat rail extends in a direction from the pivot point toward the magnetic region, the magnetic seat rail is bent at a position near to the magnetic region, and the magnetic resistance generated when the at least one guide post slides to the first end is greater than the magnetic resistance generated when the at least one guide post slides to the second end.

4. The resistance device of the fitness machine of claim 3, wherein:

the at least one magnetic seat has a seat body pivotally connected to the guide rail disc and at least one magnetic member provided on the seat body, the seat body has the magnetic seat rail, the at least one magnetic member forms the magnetic region, a projection of the at least one magnetic member overlaps the metal ring sheet when the at least one guide post is located at the first end, and the projection of the at least one magnetic member does not fall within a range of the metal ring sheet when the at least one guide post is located at the second end of the magnetic seat rail.

5. The resistance device of the fitness machine of claim 1, wherein:

the at least one magnetic seat is two magnetic seats, the at least one guide post is two guide posts, and the two magnetic seats are symmetrically arranged about the axis of the rotation shaft as a center.

6. The resistance device of the fitness machine of claim 5, wherein each magnetic seat of the two magnetic seats has a seat body pivotally connected to the guide rail disc and at least one magnetic member provided at the seat body.

7. The resistance device of the fitness machine of claim 1, wherein a position of the at least one magnetic seat on the axis of the rotation shaft is located between the guide rail disc and the metal ring sheet.

8. The resistance device of the fitness machine of claim 1, wherein:

the wind drag unit further comprises an indicator fixed to the air volume adjusting disc, and the indicator is exposed from the housing and is configured to indicate a resistance level.

9. The resistance device of the fitness machine of claim 1, wherein:

the metal ring sheet is in an annular shape, the guide rail disc is in a disc shape, and a central axis of the metal ring sheet and a central axis of the guide rail disc overlap each other.

10. A fitness machine, comprising:

a frame unit;

a force application assembly operationally provided on the frame unit; and a resistance device that is configured to generate a resistance, mounted on the frame unit, and connected to the force application assembly, wherein the resistance device comprises:

a wind drag unit; and a magnetic resistance unit, wherein:

the wind drag unit comprises a housing, a wind wheel, a rotation shaft, and an air volume adjusting disc, the wind wheel and the air volume adjusting disc are mounted in the housing, the wind wheel is fixedly connected to the rotation shaft and is rotatable around an axis of the rotation shaft relative to the housing, the air volume adjusting disc is rotatable relative to the housing and coordinates with the housing to define a flow channel for air flow, a flow rate of the flow channel is adjusted by rotating the air volume adjusting disc, the magnetic resistance unit is adjustably provided in the wind drag unit, and the magnetic resistance unit comprises:

a guide rail disc that surrounds the axis of the rotation shaft and is fixedly connected to the housing, wherein the guide rail disc has at least one guide disc rail;

a metal ring sheet that surrounds the axis of the rotation shaft and rotates with the wind wheel;

at least one magnetic seat that has magnetism and is configured to generate a magnetic resistance with the metal ring sheet, wherein the at least one magnetic seat is pivotally provided on the guide rail disc and has a magnetic seat rail; and at least one guide post that is connected to the air volume adjusting disc and penetrates through the at least one guide disc rail and extends into the magnetic seat rail, the at least one guide post moves in the magnetic seat rail with rotation of the air volume adjusting disc to drive the at least one magnetic seat to pivotally rotate relative to the guide rail disc so as to adjust relative positions of the at least one magnetic seat and the metal ring sheet, so that a magnitude of the magnetic resistance is adjustable.

11. The fitness machine of claim 10, wherein:

the magnetic seat rail has a first end, a second end opposite to the first end, and a turning portion between the first end and the second end, when the at least one guide post is located at the second end, the resistance device of the fitness machine only generates a wind drag, and when the at least one guide post slides from the second end and passes through the turning portion, the resistance device of the fitness machine generates the wind drag and the magnetic resistance at the same time.

12. The fitness machine of claim 11, wherein:

the at least one magnetic seat further has a pivot point pivotally connected to the guide rail disc and a magnetic region away from the pivot point for generating the magnetic resistance with the metal ring sheet, the magnetic seat rail extends in a direction from the pivot point toward the magnetic region, the magnetic seat rail is bent at a position near to the magnetic region, and the magnetic resistance generated when the at least one guide post slides to the first end is greater than the magnetic resistance generated when the at least one guide post slides to the second end.

13. The fitness machine of claim 12, wherein:

the at least one magnetic seat has a seat body pivotally connected to the guide rail disc and at least one magnetic member provided on the seat body, the seat body has the magnetic seat rail, the at least one magnetic member forms the magnetic region, a projection of the at least one magnetic member overlaps the metal ring sheet when the at least one guide post is located at the first end, and the projection of the at least one magnetic member does not fall within a range of the metal ring sheet when the at least one guide post is located at the second end of the magnetic seat rail.

14. The fitness machine of claim 10, wherein:

the at least one magnetic seat is two magnetic seats, the at least one guide post is two guide posts, and the two magnetic seats are symmetrically arranged about the axis of the rotation shaft as a center.

15. The fitness machine of claim 14, wherein each magnetic seat of the two magnetic seats has a seat body pivotally connected to the guide rail disc and at least one magnetic member provided at the seat body.

16. The fitness machine of claim 10, wherein a position of the at least one magnetic seat on the axis of the rotation shaft is located between the guide rail disc and the metal ring sheet.

17. The fitness machine of claim 10, wherein:

the wind drag unit further comprises an indicator fixed to the air volume adjusting disc, and the indicator is exposed from the housing and is configured to indicate a resistance level.

18. The fitness machine of claim 10, wherein:

the metal ring sheet is in an annular shape, the guide rail disc is in a disc shape, and a central axis of the metal ring sheet and a central axis of the guide rail disc overlap each other.

* * * * *